US005477647A

United States Patent [19]

Yates, Jr.

[11] Patent Number: 5,477,647

[45] Date of Patent: *Dec. 26, 1995

[54] DECORATIVE ART GLASS WINDOW GRID SYSTEM

[76] Inventor: H. Dale Yates, Jr., 6999 Oakland Rd., Loveland, Ohio 45140

[ * ] Notice: The term of this patent shall not extend beyond the expiration date of Pat. No. 5,251,417.

[21] Appl. No.: 306,629

[22] Filed: Sep. 15, 1994

[51] Int. Cl.[6] ..... E06B 3/968

[52] U.S. Cl. ..... 52/204.57; 52/204.58; 52/204.59; 52/204.6; 52/204.61; 52/204.7; 52/456; 52/314; 52/656.2; 52/656.8; 52/664; 52/788.1; 40/572

[58] Field of Search ..... 52/204.57, 204.58, 52/204.59, 204.6, 204.61, 204.7, 456, 311.2, 311.3, 314, 656.2, 656.8, 664, 668, 790, 788.1; 40/572

[56] References Cited

U.S. PATENT DOCUMENTS

| | | | |
|---|---|---|---|
| 3,024,880 | 3/1962 | Burmeister . | |
| 3,460,303 | 8/1969 | Algrain et al. . | |
| 3,512,320 | 5/1970 | Ferron et al. . | |
| 3,678,651 | 7/1972 | Hicks | 52/204.61 |
| 4,145,858 | 3/1979 | Dovman | 52/668 X |
| 4,316,352 | 2/1982 | Harrington et al. . | |
| 4,907,389 | 3/1990 | Pettit | 52/668 |
| 5,251,417 | 10/1993 | Yates, Jr. | 52/456 |

FOREIGN PATENT DOCUMENTS 684931 12/1952 United Kingdom .

*Primary Examiner*—Carl D. Friedman
*Assistant Examiner*—Christopher Todd Kent
*Attorney, Agent, or Firm*—Charles R. Wilson

[57] ABSTRACT

A decorative art glass grid system is intended for use in a double window pane unit. The unit itself fits into a window frame. The grid system comprises at least two notched elongated members to form a grid, a set of holding feet slidably positioned in the terminuses of the elongated members and, optionally, a set of resting pads positioned in the elongated members. Each notched elongated member has a first groove extending along one wall of the member to receive an edge of an art glass pane, a second groove extending along an opposite wall of the member to receive an edge of another art glass pane, an interior channel, and a notch in a third wall of the member. The notch is configured to have a dove tail-shaped receiving section and a centered recessed section to receive another notched elongated member in a locked and substantially wobble-free manner. Each holding foot has a substantially flat base which has a groove in one face to receive the edge of an art glass pane and a post extending substantially vertically from the flat base to fit into the interior channel of the notched elongated member to hold it in place. Each resting pad has a flexible head portion which receives an edge of an art glass pane. The grid system is readily adapted to any size window frame and art glass pane. It is readily assembled in the field and securely holds decorative art glass panes in a secure manner.

16 Claims, 4 Drawing Sheets

DECORATIVE ART GLASS WINDOW GRID SYSTEM

FIELD OF INVENTION

This invention relates to a window grid system. More particularly, the invention relates to a window grid system for readily mounting decorative art glass in a substantially wobble-free manner.

BACKGROUND OF INVENTION

Windows are placed in buildings as a source of light and for the occupant to view the outside. They are primarily functional in nature. However, some commercial and residential building owners demand more. They want their windows to be aesthetically pleasing as well as functional. Leaded glass is one example of a material used to produce a decorative window. Beveled glass is another example of glass used in a window to give an aesthetically pleasing appearance.

Various grid systems for mounting in a window frame exist. My U.S. Pat. No. 5,251,417 discloses one such grid system. The system has a grid which holds four or more separate panes of glass. The grid itself can be made of a decorative material such as brass. It is able to accommodate beveled glass panes, etched glass panes and other decorative glass panes. The systems are pleasingly attractive. However, they are difficult to assemble in the field where work conditions are often less than ideal. A degree of skill and patience is needed to properly assemble the system. As with all products and services, pressure is always present to minimize labor costs.

In accord with a need, there has been developed a decorative art glass window grid system. The grid system is readily mounted inside a double window pane unit. It is easy to assemble and securely holds decorative art glass panes in a substantially wobble-free manner. The system also offers versatility in the size, shape and number of glass panes.

SUMMARY OF INVENTION

A grid system for use in a window frame holds decorative art glass panes in a substantially wobble-free manner. The system comprises at least two notched elongated members, a set of holding feet slidably positioned in the terminuses of the elongated members and, optionally a set of resting pads positioned in the elongated members. Each notched elongated member has a first groove extending along one wall of the member to receive an edge of an art glass pane, a second groove extending along an opposite wall of the member to receive an edge of another art glass pane, an interior channel between the two grooves also extending along the length of the elongated member and a notch. The notch is in a third wall. It holds another notched elongated member in a locked and wobble-free manner. Each holding foot has a substantially flat base which has a groove in one face to receive an edge of an art glass pane and a post extending substantially vertically from the flat base to fit into the interior channel of the notched elongated member to hold it in place, Each resting pad has a flexible head portion which rests in a groove and receives an edge of an art glass pane, The grid system is adapted to any size window frame and art glass pane, It is readily assembled in the field and securely holds decorative art glass.

DETAILED DESCRIPTION OF INVENTION

The grid system of the invention is described in detail in the following paragraphs. The components of the grid system as well as the manner of assembling the components into the grid system to hold decorative art glass panes and mounting it within a double window pane unit are described.

Figure 1:
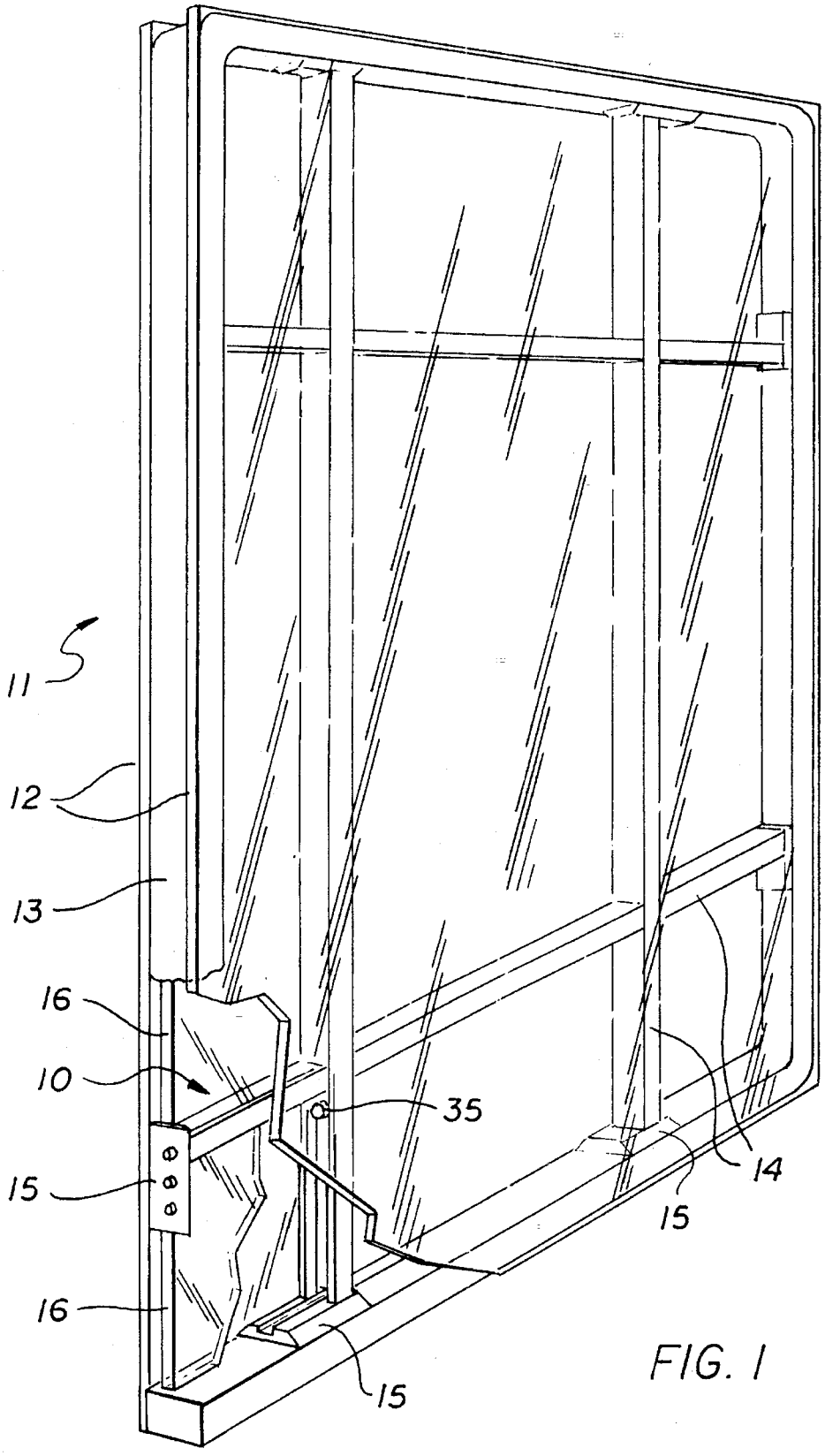
FIG. 1 is a perspective view of the grid system of the invention mounted in a double window pane unit.

With reference to FIG. 1, there is shown the grid system 10 of the invention mounted in a sealed double window pane unit 11. The sealed unit comprises two window panes 12 and a frame 13 along the four sides as its essential components. In the unit shown, the frame 13 is a soft polymeric strip liner which goes around the interior edges of the two window panes. The double window pane unit itself is ready for mounting in a window frame of a commercial or residential building.

The grid system 10 comprises as its essential components a set of at least two notched elongated members 14 and a set of holding feet 15. The components of the system are structured to hold a number of art glass panes 16 in a centered substantially wobble-free manner within the double window pane unit 11.

The grid system 10 shown is configured to hold nine panes of art glass. It should be understood that other configurations are possible to hold more or less art glass panes. It should also be understood that the individual glass panes can be the same or different. That is, the panes can individually or collectively be beveled glass, etched glass or conventional glass. The notched elongated members are configured to accommodate the narrow beveled glass edges as well as the typical conventional glass edges. As evident in FIG. 1, the panes can be different sizes. At least two notched elongated members are needed as a practical minimum. Two of the notched elongated members interconnected together holds four art glass panes. The upper limit of notched elongated members that can be interconnected together is dictated only by window frame size and aesthetic reasons.

The notched elongated members 14 used in the grid system 10 to form a grid are identical in structure, though have different lengths to accommodate the particular vertical and horizontal dimensions of the double window pane unit. As best seen in FIGS. 2–5, each notched elongated member 14 has two opposed generally flat walls 17 and 18 and two side walls 19 and 20 at approximate right angles thereto. The side walls 19 and 20 have grooves and an internal wall 21 connecting the two opposed walls. A first groove 22 extends entirely along one wall of the member. The groove 22 is sufficiently wide to receive an edge of a conventional glass pane, typically about 100 to 125 mils in thickness. A second groove 23 extends along an opposite wall of the elongated member its entire length. This groove also has a width sufficiently wide to receive an edge of a conventional glass pane. Preferably, for manufacturing reasons, and as shown, the bottom of the groove 23 is open and extends the entire length of the groove. The notched elongated member 14 also has an interior channel 24 extending its entire length. The channel 24 is positioned between the first groove 22 and the second groove 23. A hole 25 in the bottom wall of the first groove 22 and a slot 26 in the bottom wall of the second groove 23 are for the purpose of accommodating the resting pads as more fully discussed below.

Figure 3:
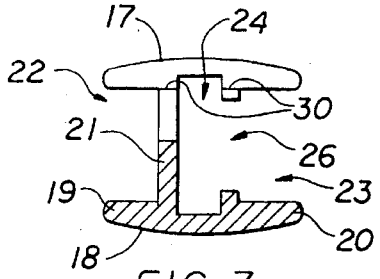
FIG. 3 is a view in section of the notched elongated member of FIG. 2 taken along line 3—3 thereof.

As is most apparent in FIG. 3, the first groove 22, the second groove 23 and the interior channel 24 all run the entire length of the elongated member 14 and are all parallel with one another. The second groove and the interior channel are in communication due to the slot 26 in their common wall.

Figure 2:
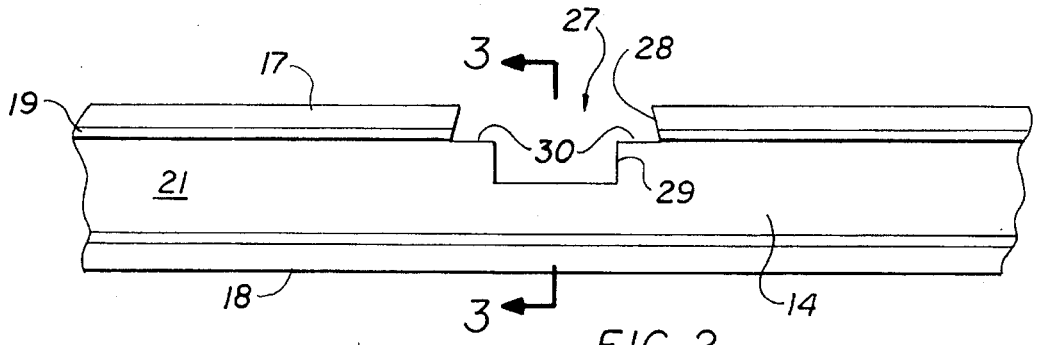
FIG. 2 is an elevational side view of a notched elongated member used in the grid system of FIG. 1.

As best seen in FIG. 2, each elongated member 14 has at least one notch in one generally flat wall. The notch is to accommodate a notch of another elongated member at the point where the members interconnect. The notch 27 is cut into the elongated member's generally flat wall 17 where needed. The notch extends approximately to the center-line of the internal wall 21. It has a dove tail-shaped receiving section 28 and a recessed section 29 extending inwardly therefrom. The receiving section 28 is configured to receive another notched elongated member and hold it in a locked manner. This greatly facilitates the grid system's assembly in the field in that once the members are connected they remain so. The recessed section 29 has a more narrow opening than the dove tail-shaped section of the notch to create internal ledges 30 substantially parallel to the generally flat walls 17 and 18. The ledges 30 provide a surface for like ledges of another notched elongated member to rest in a substantially wobble-free state. The internal ledges are all individually substantially flat and collectively form a broad flattened surface which is conducive to receiving a like flattened surface of another similarly configured notched elongated member.

Figure 4:
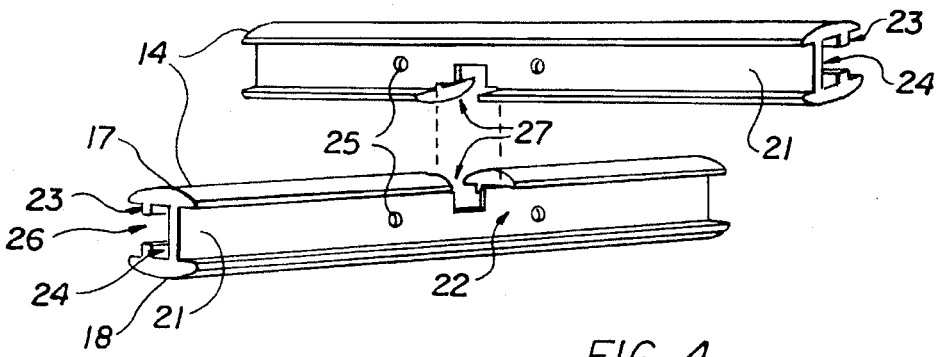
FIG. 4 is a perspective view of two notched elongated members of the grid system of FIG. 1 prior to assembly.
Figure 5:
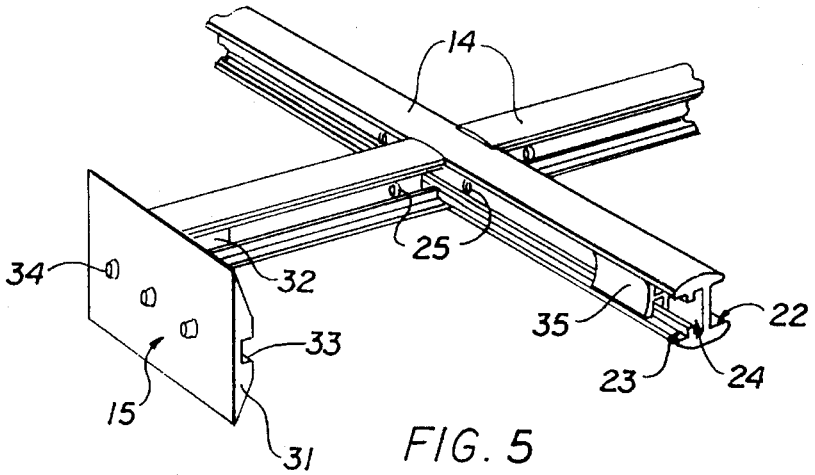
FIG. 5 is a perspective view in reverse of the notched elongated members of FIG. 4 in an assembled state.

The notched elongated members 14 are made from a yieldable material, e.g. brass or aluminum. In assembly, two of the elongated members are individually grasped and a bending force applied to open the dove tail-shaped section of the notches (as generally indicated in FIG. 4). While one is held in the widened position, the second elongated member is positioned into the first member's dove tail-shaped section and the recessed section of the notch. Once fully positioned, a reverse bending force is applied to close the openings to their initial sizes. As such, the narrowed mouth of the dove tail-shaped section extends slightly over the other elongated member as seen in FIG. 5 and effectively locks it in place.

The holding feet 15 are positioned in the terminuses of the elongated members 14. They serve the purpose of holding an edge of art glass pane in a stable position in the grid system and as a means of centering the complete grid system in the double window pane unit. Each holding foot has a substantially flat base 31 and a substantially vertical post 32 extending from it. The holding foot also has a groove 33 extending along the center of the face of the flat base up to the post. The flat base has a width sufficient to snugly fit into the double window pane frame. The groove 33 has a width to receive a narrowed edge of the art glass pane such as found on beveled glass. The flat base width and the centered groove of the holding foot ensures that the grid system is centered in the double window pane frame. The length of the substantially flat base is not critical, though generally is about one-half inches to about one inch or manufacturing and assembly reasons. Alternatively, the vertical post can be centered in the flat base and grooves in the flat base extend from both of its sides to hold edges of two adjacent art glass panes.

Preferably, each holding foot also has a coupling means on its back side to aid in mounting the grid system in the double window pane unit. The coupling means interact with the frame of the double window pane unit to aid in the assembling and to better hold the two components together. As best seen in FIG. 5, a set of cones 34 protruding from the back side of the flat base 31 act as coupling means. Since the frame 13 of the double window pane unit 11 is a soft polymeric strip liner, the cones 34 become embedded in the liner sufficiently to hold them together. The interaction need only be strong enough to aid in the assembly. Once assembled, the frame of the unit provides the permanent holding force necessary. Other mechanical coupling means, such as tabs, posts, etc. can be used.

The vertical post 32 on each of the holding feet 15 fits axially into the interior channel 24 of the elongated member 14 at its terminus. It is preferably dimensioned to snugly fit into the channel to hold the holding foot steady relative to the notched elongated member.

Resting pads are used to ensure that the art glass panes are mounted in the elongated members in a rattle free state. They are used in a highly preferred embodiment of the invention. Each pad is capable of being positioned in either the first groove or the second groove at a point where it will best receive an edge of the art glass pane and, in conjunction with the holding feet, hold it in a substantially stable state. Thus, as seen in FIG. 1, the resting pad 35 is positioned near an interior corner of the grid where two notched elongated members interconnect. Normally, one resting pad properly positioned for each interior edge of the art glass pane in the grid is sufficient, though a plurality of pads for one or more of the art glass pane edges can be used for added stability.

Figure 7:
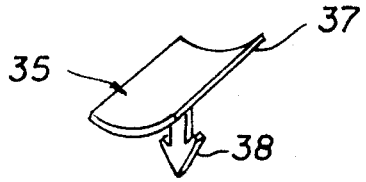
FIG. 7 is a perspective view of a first resting pad used in the grid system of FIG. 1.
Figure 8:
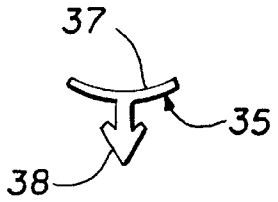
FIG. 8 is an end view of the resting pad of FIG. 7.
Figure 9:
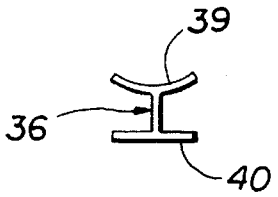
FIG. 9 is an end view of a second resting pad used in the grid system of FIG. 1.
Figure 6:
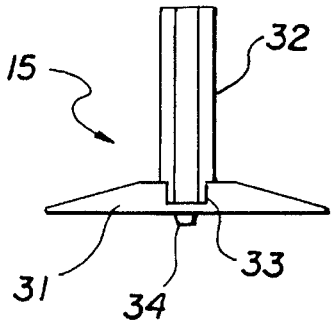
FIG. 6 is an end view of a holding foot used in the grid system of FIG. 1.

Each resting pad is structured according to whether it will be used in a groove with a closed bottom or a groove with an open bottom. The resting pad 35 shown in FIGS. 7 and 8 is used in the first groove of the elongated member 14 while the resting pad 36 shown in FIG. 9 is used in the second groove of the elongated 25 member 14. Each serves the purpose of providing a means whereby an interior corner of the grid is able to stably hold a piece of art glass.

The resting pad 35 has a head portion 37 and a base portion 38. The head portion 37 is preferably saddle-shaped and preferably made of a flexible material. The base portion 38 is a locking tab which extends from the head portion 37. It mates with the hole 25 punched into the internal wall 21 of a notched elongated member prior to assembly. The holes in the internal wall are normally positioned near an interior corner of the grid for optimum stability. Other holding means on the head portion of various designs and first groove modifications are possible for accomplishing the same purpose. For example, an adhesive backing on the head portion can serve as a holding means. Each resting pad 36 of FIG. 9 to be used in a second or open bottom groove of the notched elongated member 14 is comprised of a head portion 39 and a base portion 40. The base portion is preferably rigid or semi-rigid and the head portion is flexible. The base portion has an inverted T-shape and is dimensioned to fit into the interior channel and slide along it with the head portion extending into and dimensioned to fit in the bottom area of the second groove 23. As such, the flexible head portion of the pad provides a seat for an edge of the art glass pane and adds a measure of stability. Preferably, the head portion 39 of the pad is saddle-shaped to better receive different thicknesses of glass panes.

The grid system 10 is readily assembled and installed in the double window pane unit 11. Initially, the notched elongated members are cut to length. They are interconnected by matching up the notches of each of the vertical members with the notches of the horizontal members. At least one member, preferably both members, is slightly bent to open up its notch as above described and positioning the other elongated member to form a grid. The close fit gives a connection strong enough for the assembly. Next, the resting pads are pushed into the holes of the first groove where needed and other resting pads slid through the interior channel and second groove to near an interior corner where needed. The individual panes of glass are positioned in their respective sections and the holding feet slid into position. Once the holding feet are positioned, the art glass panes are secured. The glass panes are also centered due to the resting pads and holding feet grooves. The whole grid system is now ready for assembly into the double window pane unit. The grid system is placed on one window pane, the frame strip added around its periphery and the second window pane added. The whole unit is finally sealed and permanently mounted in the window frame in a conventional manner.

Figure 10:
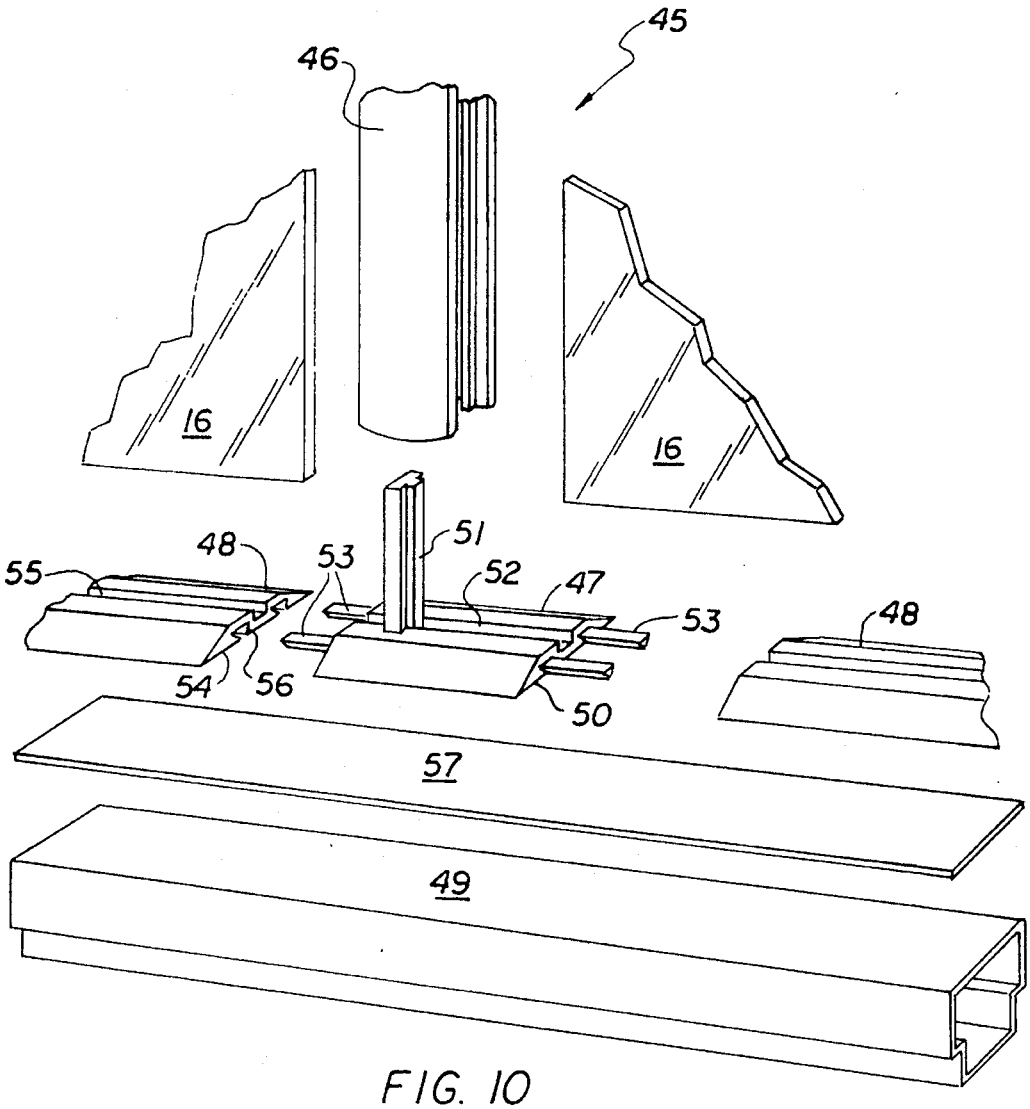
FIG. 10 is an exploded partial view in perspective showing an alternative grid system of the invention.
Figure 11:
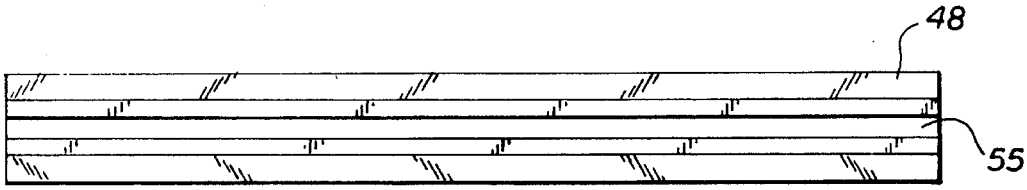
FIG. 11 is a top view of an intermediate mounting member used in the grid system of FIG. 10.

FIGS. 10 and 11 illustrate another embodiment of the grid system of the invention and another double window pane unit. This embodiment provides an especially secure means to hold art glass panes in the notched elongated members. The grid system 45 as evident in FIG. 10 comprises notched elongated members 46, holding feet 47, and intermediate mounting members 48. Resting pads (not shown) are also optionally used in the notched elongated members. The notched elongated members 46 and resting pads are as described above with reference to FIGS. 1–8. The holding feet 47 and intermediate mounting members 48 are structured to lock together and extend the full length of one side of the grid system. The double window pane unit is similar to that described above except different frame strips are used. Thus, metal strips 49 extend around the two window panes and are connected together at their corners.

Each of the holding feet 47 has a substantially flat base 50 and a substantially vertical post 51 extending therefrom. The holding foot also has a groove 52 extending along the center of the face of the flat base up to at least one side of the post. A set of tabs 53 extend axially from the flat. base at each end thereof. The tabs 53 are for locking into the intermediate mounting member 48 further discussed below.

The intermediate mounting member 48 is to hold an edge of the art glass and works in conjunction with the holding feet 47 to ensure that the entire collective lengths of the individual glass panes are held. The member 48 has a substantially flat base 54 with a groove 55 running along the center of its face. The flat base 54 also has recesses 56 in each end to receive the tabs 53 of the holding feet 47. Thus, the two recesses 56 in each end are in alignment with two tabs 53 in each holding foot 47. When assembled, the holding feet and intermediate mounting members alternate along one side of the grid system. The result is that all the individual panes of glass mounted in the system are held along their entire periphery. Optionally, and as shown in FIG. 10, a butyl adhesive strip 57 extends along the frame metal strip 49. Its purpose is to better hold the components together and also provide a cushioning and tightening effect to the grid system.

Figure 12:
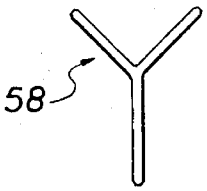
FIG. 12 is a perspective view of an internal connector used in another grid system configuration of the invention.
Figure 13:
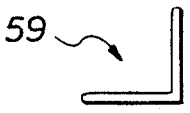
FIG. 13 is a perspective view of another internal connector used in a grid system configuration of the invention.
Figure 14:
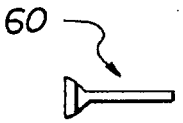
FIG. 14 is a perspective view of still another internal connector used in a grid system configuration of the invention.

FIGS. 12–14 illustrate internal connectors which are used with certain pane configurations. Each is configured with at least one post for inserting into the interior channels of adjoining notched elongated members to hold them together. Necessarily, the connectors have a shape dependent on the shape of the pane design. The internal connector 58 of FIG. 12 has a Y-shape with three posts to hold together three notched elongated members. The internal connector 59 of FIG. 13 is right angled with two posts. The internal connector 60 of FIG. 14 is a straight shape with one post.

While the invention has been described with particular references to the drawings, it should be understood various modifications can be made. All modifications of an obvious nature are considered within the scope of the appended claims.

I claim:

1. A grid system for securely holding a number of decorative art glass panes in a double window pane unit, said grid system comprising:

(a) a set of at least two notched elongated members dimensioned to interconnect with one another to form a grid and having sufficient lengths for mounting in the double window pane unit, each said notched elongated member having (i) two opposed generally flat walls, (ii) a side wall with a first groove extending along the member for receiving an edge of the decorative art glass pane, (iii) an opposite side wall with a second groove extending along the member for receiving an edge of another decorative art glass pane, (iv) an interior channel extending along the member between said first and second grooves, and (v) a notch in one generally flat wall of the member to interconnect with another notched elongated member, said notch extending to an approximate center-line of the member and having a dove tail-shaped receiving section extending partially into said one generally flat wall for locking the other notched elongated member therein and a centered recessed section extending inwardly from the dove tail-shaped section to create an internal set of ledges substantially parallel to the generally flat walls of the member, said ledges stabilizing the other notched elongated member thereon; and (b) a set of holding feet, each said holding foot slidably positioned in the interior channel of one of the notched elongated members, each foot having a substantially flat base which is adapted to be mounted in the double window pane unit, said flat base having a face with a groove extending along a center of the face to snugly hold an edge of each decorative art glass pane capable of being associated therewith and further having a post extending substantially vertically from the face of the flat base to fit into the interior channel of the notched elongated member to hold said foot in position.

2. The grid system of claim 1 wherein each notched elongated member is made of a yieldable material such that the dove tail-shaped receiving section of the notch is capable of being widened by a bending force to receive another notched elongated member and then narrowed by a reverse bending force to lock the other notched elongated member therein.

3. The grid system of claim 2 wherein each notched elongated member is made of brass.

4. The grid system of claim 2 wherein each notched elongated member is made of aluminum.

5. The grid system of claim 2 further having a set of resting pads positioned in the grooves of the notched elongated members, each pad having a flexible head portion for receiving an edge of the decorative art glass and a holding means for retaining the resting pad in the groove of the notched elongated member.

6. The grid system of claim 5 wherein at least one of the resting pads is positioned in the first groove of the notched elongated member and at least one of the resting pads is positioned in the second groove of a notched elongated member.

7. The grid system of claim 5 wherein the second groove of the notched elongated member further has a slot in a bottom wall extending its length.

8. The grid system of claim 1 wherein the holding feet are further characterized in having coupling means on a back side of the flat base to aid in mounting the system in the double window pane unit.

9. A double window pane unit comprising two window panes with a frame extending around peripheries of the two window panes and suited for mounting in a window frame and having a grid system for holding decorative art glass panes positioned between said two window panes, said grid system having:

(a) a set of at least two notched elongated members dimensioned to interconnect with one another to form a grid and having sufficient lengths for mounting within the confines of the window panes, each said notched elongated member having (i) two opposed generally flat walls, (ii) a side wall with a first groove extending along the member to receive an edge of each decorative art glass pane capable of being associated therewith, (iii) an opposite side wall with a second groove extending along the member to receive an edge of another decorative art glass pane capable of being associated therewith, (iv) an interior channel extending along the notched elongated member between said first groove and said second groove, and (v) a notch in one generally flat wall of the member to interconnect with another notched elongated member, said notch extending to an approximate center-line of the member and having a dove tail-shaped receiving section to lock another of said at least two notched elongated members therein and a centered recessed section extending inwardly therefrom to create an internal set of ledges to provide a surface for the another notched elongated member to sit in a substantially wobble-free manner; and (b) a set of holding feet, each said holding foot slidably positioned in the interior channel of one of the notched elongated members, each foot having a substantially flat base which is mounted in the double window pane unit, said flat base having a face with a groove to snugly hold an edge of each decorative art glass pane capable of being associated therewith and a post extending substantially vertically from the face of the flat base to fit into the interior channel of the notched elongated member.

10. The double window pane unit of claim 9 wherein the frame is a soft polymeric strip liner.

11. The double window pane unit of claim 9 wherein the frame is a metal strip.

12. The double window pane unit of claim 9 further comprising a set of resting pads positioned in the grooves of the notched elongated members, each pad having a flexible head portion for receiving an edge of the decorative art glass.

13. The double window pane unit of claim 12 wherein at least one of the resting pads is positioned in the first groove of a notched elongated member and at least one of the resting pads is positioned in the second groove of a notched elongated member.

14. The double window pane unit of claim 9 wherein each holding foot of the grid system is further characterized in having coupling means on a back side of the flat base of the holding foot to aid in mounting the system in the double window pane unit.

15. The double window pane unit of claim 9 wherein each notched elongated member is made of brass.

16. The double window pane unit of claim 9 wherein each notched elongated member is made of aluminum.

* * * * *